US007127968B1

(12) United States Patent
Kriegar

(10) Patent No.: US 7,127,968 B1
(45) Date of Patent: Oct. 31, 2006

(54) MECHANIZED ROOFING REMOVAL TOOL

(76) Inventor: Cindy A. Kriegar, 303 Brooks Ave., Rochester, NY (US) 14619

( * ) Notice: Subject to any disclaimer, the term of this patent is extended or adjusted under 35 U.S.C. 154(b) by 0 days.

(21) Appl. No.: 11/167,731

(22) Filed: Jun. 28, 2005

(51) Int. Cl.
*E04D 15/00* (2006.01)

(52) U.S. Cl. ..... 81/45; 81/46; 30/170

(58) Field of Classification Search ..... 81/45, 81/46; 301/70; 299/36.1; 254/15; 30/169, 30/170
See application file for complete search history.

(56) References Cited

U.S. PATENT DOCUMENTS

| | | | | | |
|---|---|---|---|---|---|
| 4,663,995 | A * | 5/1987 | Amundson et al. | ..... | 81/45 |
| 4,763,547 | A * | 8/1988 | Dike, Jr. | ..... | 81/45 |
| 5,741,047 | A * | 4/1998 | Ordonez | ..... | 299/37.1 |
| 5,800,021 | A * | 9/1998 | Derr | ..... | 299/37.1 |
| 5,819,603 | A * | 10/1998 | Murray | ..... | 81/45 |
| 6,095,015 | A * | 8/2000 | Phelan | ..... | 81/45 |
| 6,393,948 | B1 * | 5/2002 | Hutchins | ..... | 81/45 |
| 6,711,971 | B1 * | 3/2004 | Morin | ..... | 81/45 |
| 7,013,758 | B1 * | 3/2006 | Gendron | ..... | 81/45 |
| 2002/0053261 | A1 * | 5/2002 | Arturo et al. | ..... | 81/45 |
| 2004/0035274 | A1 * | 2/2004 | Fasnacht et al. | ..... | 83/468.3 |
| 2004/0123554 | A1 * | 7/2004 | Slack | ..... | 52/749.12 |
| 2005/0120831 | A1 * | 6/2005 | Parker et al. | ..... | 81/45 |
| 2006/0026909 | A1 * | 2/2006 | Cross | ..... | 52/127.5 |

* cited by examiner

*Primary Examiner*—David B Thomas
*Assistant Examiner*—Robert Scruggs
(74) *Attorney, Agent, or Firm*—Crossley Patent Law; Mark A. Crossley

(57) ABSTRACT

A tool designed specifically for removing roofing shingles, sub-roofing, and the like from roofs, offered in two examples, one powered pneumatically and one powered electrically, each with an elongated adjustable stalk with handle, the lower end of the stalk with an upper blade that moves forward and rearward with respect to the lower blade, a circular saw rotatably disposed between the blades, the forward movement of the upper blade coinciding with upward movement of the upper blade platform and teeth, thereby lifting roofing materials, the saw cutting roofing nails and the like.

9 Claims, 3 Drawing Sheets

MECHANIZED ROOFING REMOVAL TOOL

BACKGROUND OF THE INVENTION

Various devices for removing roofing materials, such as shingles, tar paper, and other sub-roofing have attempted to address the various problems of removal. These problems include (a) removing sub-roofing of various types and thicknesses, (b) removing roofing over the sub-roofing, (c) sheering or removing roofing nails, (d) powering of such a device to eliminate rigorous labor and to save time, (e) powering the device without unduly jarring an operator, (f) adjustability for fitting such a device to various workers, (g) reduction of worker fatigue in operating such a device, and (e) providing a device that lifts the materials to be removed. With such a diverse and difficult number of problems to address in roofing removal, no one device has yet done so successfully. The present invention offers solutions to these and other more minor problems.

FIELD OF THE INVENTION

The invention relates to roofing removal devices and more specifically to a mechanized roofing removal apparatus with dual cutting and lifting action.

SUMMARY OF THE INVENTION

The general purpose of the mechanized roofing removal apparatus, described subsequently in greater detail, is to provide a mechanized roofing removal apparatus which has many novel features that result in an improved mechanized roofing removal apparatus which is not anticipated, rendered obvious, suggested, or even implied by prior art, either alone or in combination thereof.

To accomplish this, the invention comprises a tool designed specifically for removing roofing shingles, sub-roofing, and the like from roofs. The invention is offered in two examples, one powered pneumatically and one powered electrically. The invention has an elongated handle that is adjustable in length. The handle and profile of the invention resemble a typical weed eater. The working end of the invention has an upper blade that moves forward and rearward, also termed distally and proximally, with respect to the lower blade. A circular saw is rotatably disposed between the two blades. The forward movement of the upper blade coincides with upward movement of the platform and teeth of the upper blade, thereby lifting roofing materials. The saw cuts roofing nails and the like. The invention offers a relatively shock free operation unlike other devices for roofing removal.

Thus has been broadly outlined the more important features of the mechanized roofing removal apparatus so that the detailed description thereof that follows may be better understood and in order that the present contribution to the art may be better appreciated.

Numerous objects, features and advantages of the mechanized roofing removal apparatus will be readily apparent to those of ordinary skill in the art upon reading the following detailed description of presently preferred, but nonetheless illustrative, examples of the mechanized roofing removal apparatus when taken in conjunction with the accompanying drawings. In this respect, before explaining the current examples of the mechanized roofing removal apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the mechanized roofing removal apparatus. It is therefore important that the claims be regarded as including such equivalent constructions insofar as they do not depart from the spirit and scope of the present invention.

Objects of the mechanized roofing removal apparatus, along with various novel features that characterize the invention are particularly pointed out in the claims forming a part of this disclosure. For better understanding of the mechanized roofing removal apparatus, its operating advantages and specific objects attained by its uses, refer to the accompanying drawings and description.

DETAILED DESCRIPTION OF THE DRAWINGS

With reference now to the drawings, and in particular FIGS. 1 through 9 thereof, example of the mechanized roofing removal apparatus employing the principles and concepts of the present invention and generally designated by the reference number 10 will be described.

Figure 8:
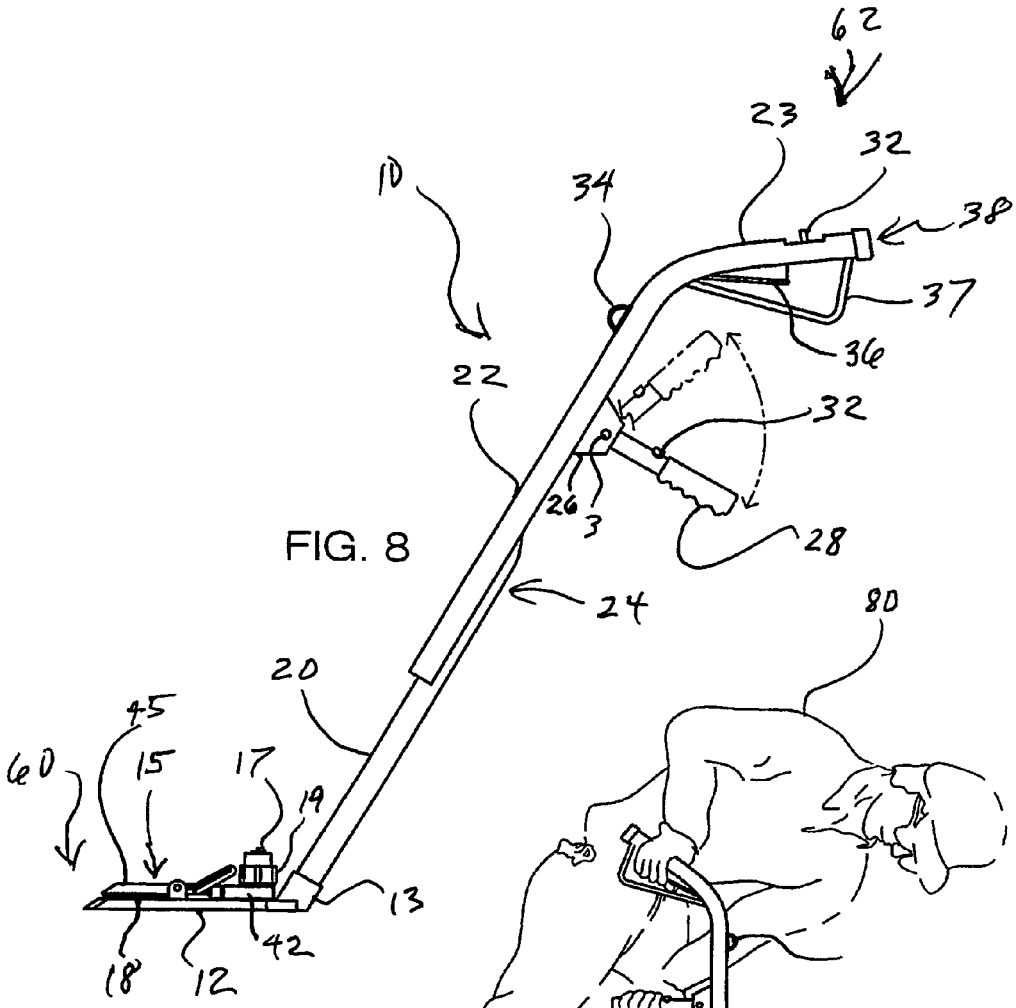
FIG. 8 is a lateral elevation view of the invention.
Figure 9:
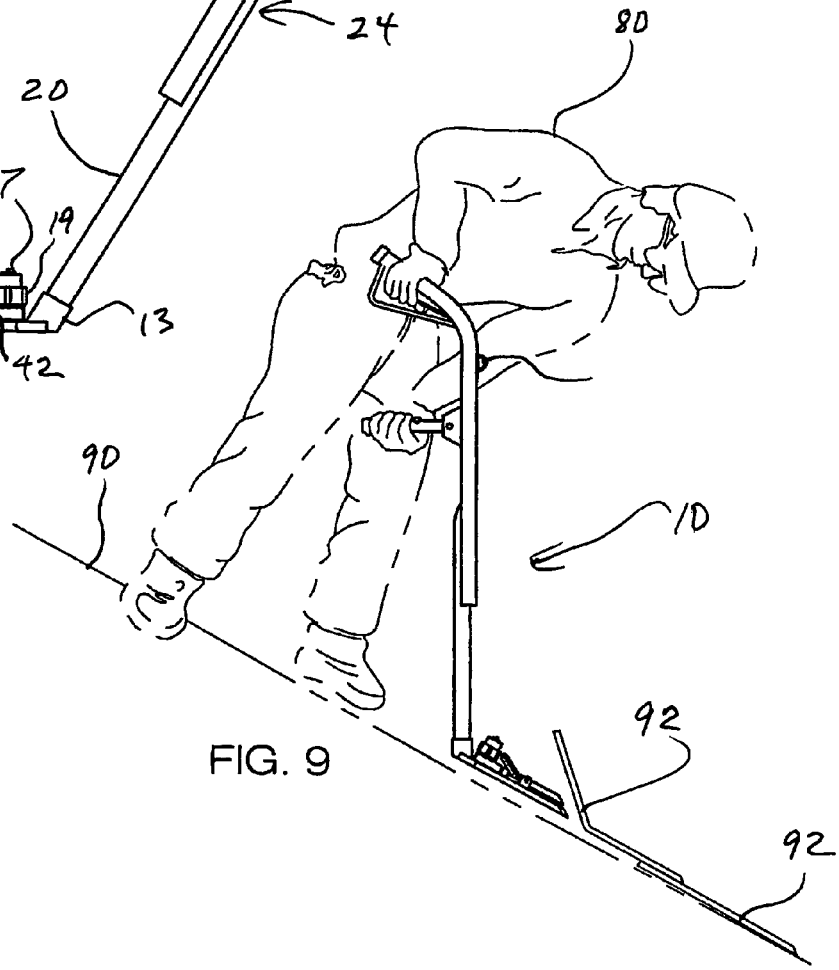
FIG. 9 is a lateral view of the invention in use.

Referring to FIGS. 8 and 9, the invention 10 comprises an upper stalk 22 and a lower stalk 20. The upper stalk 22 and the lower stalk 20 meet in an approximate center in an adjustment region 24 which affords adjustability of the overall length of the combined upper stalk 22 and lower stalk 20. The handle 23 is disposed at the upper end of the upper stalk 22. The lower blade 12 is disposed at the lower end of the lower stalk 20. The lower blade 12 is joined at an angle to the lower stalk 20 by the stalk receiver 13. The drive cylinder 42 is disposed on the top of the lower blade 12. The coupling 38 at the upper end of the handle 23 provides for coupling with the power source (not shown) of the invention 10. The invention 10, in separate examples, is powered by electricity or by air. The electrically powered example of the invention utilizes the coupling 38 to plug into electrical power. The drive cylinder 42 is a solenoid in the electrical example of the invention 10. The coupling 38 is a pneumatic coupling 38 in the pneumatically driven example of the invention 10. The drive cylinder 42 is pneumatically driven in the pneumatic example of the invention 10. Pneumatically driven cylinders 42 are well known in the industrial arts. The trigger control 36 is disposed within the handle 23 of the upper stalk 22. A trigger guard 37 partially surrounds the trigger control 36. The handle 23 further comprises a safety 32. The safety 32 must be depressed prior to the trigger control 36 being engaged. A saw control lever 28 is disposed on the upper stalk 22 in the same plane as and below the trigger control 36. The saw control lever 28 features a safety 32. The safety 32 must be depressed prior to engagement of the saw control lever 28. The saw control lever 28 engages the saw 18 when in the downwardly pivoted position. The saw control lever 28 pivots in the vertical plane about the lever pivot 30 affixed to the control flange 26. A strap eyelet 34 is affixed on the upper stalk 22. The strap eyelet 34 provides for a strap (not shown) to be affixed, then worn by a user 80 for more comfortable operation of the invention 10. Upon engagement of the power of the invention 10 by the trigger control 36, the upper blade 16 moves toward the distal 60, then back toward proximal 62.

The forward, also termed distal, movement of the upper blade 16 coincides with the upward movement of the upper blade platform 45. The circular saw 18 spins at the same time. Roofing nails (not shown) and the like are thereby cut. Roofing 92 is shaved off of a roof 90 and lifted. Plies of sub-roofing (not shown) are also peeled away from the roof 90.

Figure 1:
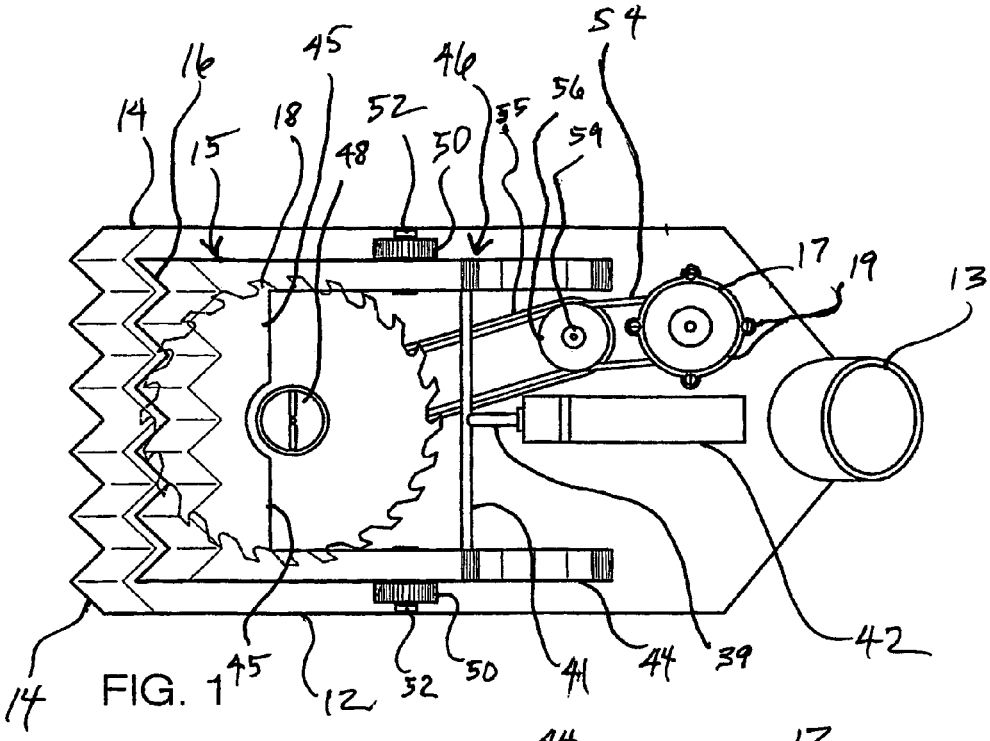
FIG. 1 is a top plan view of the circular saw positioned between the upper and lower blades, along with the related components that attach to the lower stalk of the invention.
Figure 2:
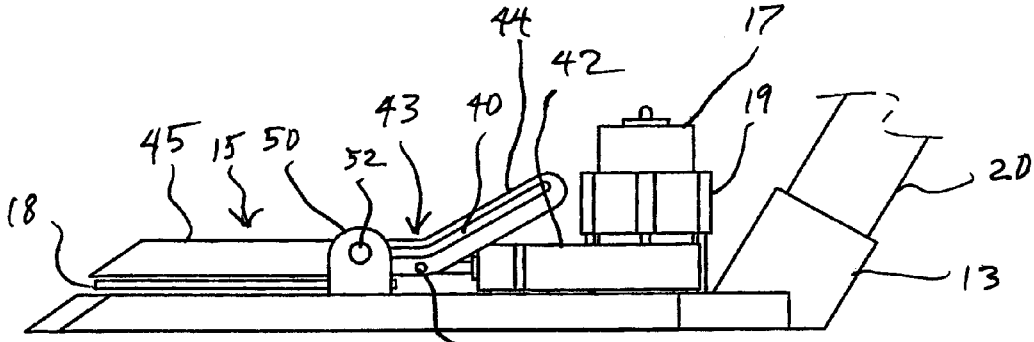
FIG. 2 is a lateral elevation view of FIG. 1, the upper blade fully proximal in its travel.
Figure 3:
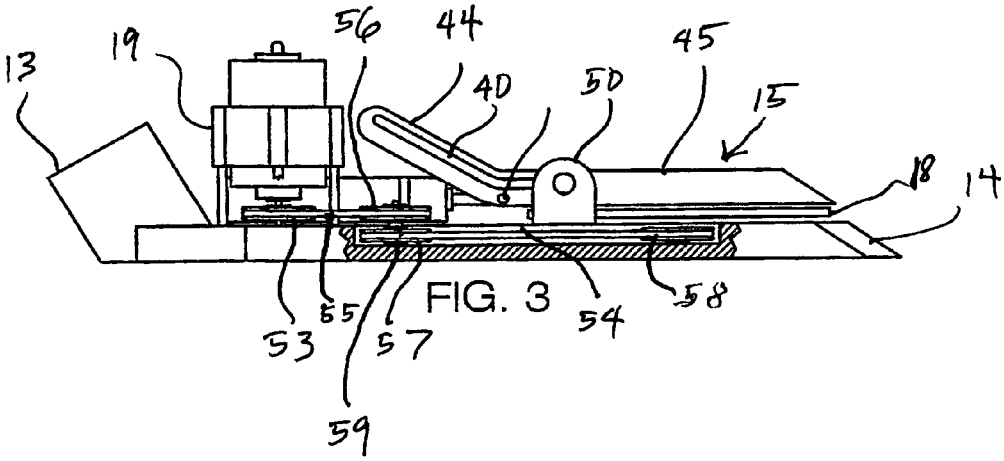
FIG. 3 is a lateral cross sectional view of the invention of FIG. 2, the invention turned 180 degrees in the horizontal plane.

Referring to FIGS. 1, 2, and 3, the lower blade 12 has a top and a bottom. A plurality of lower teeth 14 is disposed on the distal 60 end of the lower blade 12. The lower blade teeth 14 have a bevel such that the lower blade teeth 14 are most distal 60 at the bottom of the blade 12. A pair of spaced apart slide posts 50 is perpendicularly disposed on the top of the lower blade 12. The slide posts 50 are proximal to a center of the lower blade 12. The slide posts 50 are laterally disposed upon the lower blade 12. The upper blade 15 is movably positioned above the lower blade 12 and between the slide posts 50. The upper blade platform 45 of the upper blade 15 substantially comprises the distal 60 end of the upper blade 15. The upper blade teeth 16 are disposed at the distal 60 end of the upper blade platform 45. The upper blade teeth 16 have a bevel matching that of the lower teeth 14. A pair of spaced apart blade ears 46 extends proximally from the upper blade 15. The ears 46 are adjacent to inner surfaces of the lower blade slide posts 50. An acute ear bend 43 is a part of each blade ear 46. Each ear bend 43 extends proximally from the plane of the upper blade platform 45. An ear angle 44 extends rearwardly and upwardly from each ear bend 43. An elongated channel 40 is within each ear 46. The channel 40 extends from the horizontal plane of the upper blade platform 45, through the ear bend 43, and through the ear angle 44.

The channel 40 ends proximally to an end of the ear angle 44. The horizontally disposed drive pin 41 is engaged with and connects the two ear bends 43. The drive pin 41 is located below the channel 40 of each ear bend 43. The drive pin 41 pivots within each ear bend 43. The drive shaft 39 is perpendicularly affixed to a center of the drive pin 41. The drive shaft 39 extends horizontally and proximally from the drive pin 41. The drive cylinder 42 drives the drive shaft 39. The drive cylinder 42 moves the drive shaft 39 in an alternating distal 60 to proximal 62 movement, thereby moving the upper blade 15 in an alternating distal 60 to proximal 62 movement. The slide pin 52 is horizontally disposed within each slide post 50. Each upper blade 15 channel 40 is slideably engaged with each slide pin 52, whereby proximal 60 to distal 62 movement of the upper blade 15 causes the upper blade 15 to alternatingly move proximally to distally. The upper blade platform 45 and upper blade teeth 16 also alternate in up and down movement. The circular saw 18 is disposed in the horizontal plane between the lower blade 12 and the upper blade 15. The saw 18 is affixed to a drive axle (not shown) by the removable retaining screw 48. The axle is affixed to the saw pulley 58. The saw is powered by the motor 17 which is mounted to the proximal 62 top of the lower blade 12. The motor 17 is mounted to the lower blade 12 via motor mount 19. The motor 17 drives the motor pulley 53. The motor pulley 53 drives the upper drive pulley 56 via the slave belt 55. The upper drive pulley 56 shares a common pulley axle 59 with the lower drive pulley 57. The lower drive pulley drives the saw pulley 58 via the drive belt 54. The motor 17 is powered by electricity from the coupling 38 in the electrically powered example of the invention 10.

The motor 17 is pneumatic in another example of the invention 10 and is powered by air via the coupling 38 in that example.

Figure 4:
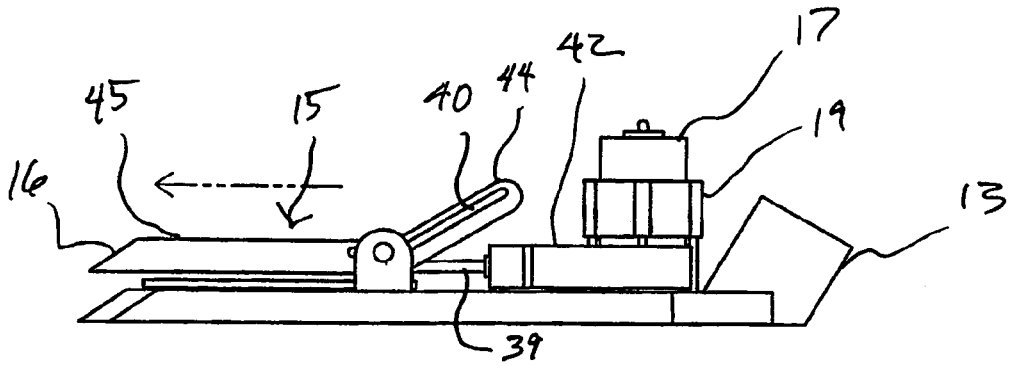
FIG. 4 is a lateral view of the invention of FIG. 2, the upper blade beginning to move distally.
Figure 5:
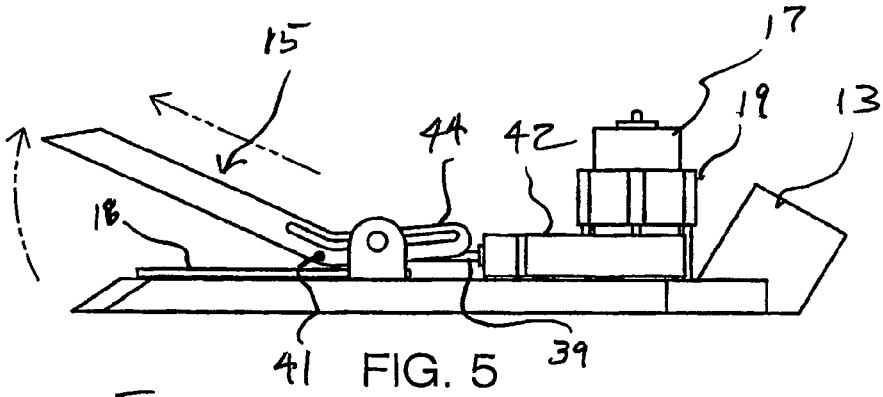
FIG. 5 is a lateral view of the invention of FIG. 4 with the upper blade farther in distal travel.
Figure 6:
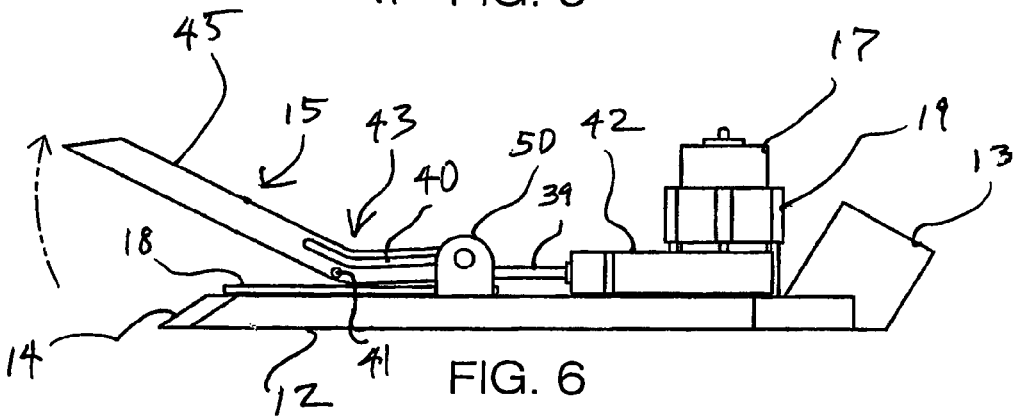
FIG. 6 is a view of the invention of FIG. 5 with the upper blade in its farthest distal travel, the upper blade platform at its greatest height.

Referring to FIGS. 4, 5, and 6, the distal 60 to proximal 62 movement of the upper blade 15 coincides with the lifting and the lowering, respectively, of the platform 45 of the upper blade 15. The drive pin 41 begins to push the upper blade 15 distally in FIG. 4. The drive pin 41 pushes the upper blade 15 further distally in FIG. 5. The drive pin 41 pushes the upper blade 15 to the furthest distal 60 point in FIG. 6.

Figure 7:
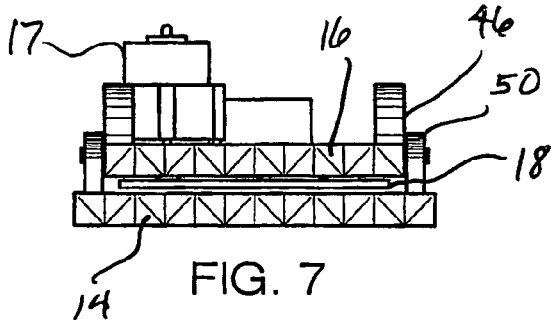
FIG. 7 is a frontal elevation of the invention's lower blade, upper blade, circular saw, and related components.

Referring to FIG. 7, the upper blade teeth 16 and the lower teeth 14 depict the closely surrounded circular saw 18. The saw 18 freely rotates between the upper blade 15 and the lower blade 12.

With respect to the above description then, it is to be realized that the optimum dimensional relationships for the parts of the mechanized roofing removal apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A mechanized roofing removal apparatus for use in removing both sub-roofing and roofing of a structure, the apparatus comprising:

a stalk having an upper end and a lower end;

a handle disposed at the upper end of the stalk;

a lower blade disposed at the lower end of the stalk, the lower blade having a top and a bottom;

a plurality of teeth on the lower blade, the teeth having a bevel such that the teeth are most distal at the bottom of the blade;

a pair of spaced apart slide posts perpendicularly disposed on a top of the lower blade, the slide posts proximal to a center of the lower blade, the slide posts laterally disposed upon the lower blade;

an upper blade movably positioned above the lower blade and between the slide posts;

a platform of the upper blade, the platform movably positioned above a distal end of the lower blade;

a plurality of teeth on the distal end of the platform, the teeth having a bevel matching that of the lower blade teeth;

a pair of spaced apart blade ears extending proximally from the upper blade platform, the ears adjacent to inner surfaces of the lower blade slide posts;

an acute ear bend in each blade ear, the ear bend angled upward from a plane of the upper blade platform;

an ear angle extended rearwardly and upwardly from the ear bend;

an elongated channel within each ear, the channel extended from the horizontal plane of the upper blade platform, through the ear bend, and through the ear angle, the channel ending proximally to an end of the ear angle;

a horizontally disposed drive pin engaged with and connecting the two ear bends of the ear angles, the drive pin located below the channel of each ear bend, the drive pin pivoting within each ear bend;

a drive shaft perpendicularly affixed to a center of the drive pin, the drive shaft extended horizontally and proximally from the drive pin;

a drive cylinder driving the drive shaft, the drive cylinder to move the drive shaft in an alternating distal to proximal movement, thereby moving the upper blade in an alternating distal to proximal movement;

a slide pin horizontally disposed within each slide post, the slide pin, each upper blade channel slideably engaged with each slide pin, whereby proximal to distal movement of the upper blade causes the upper blade platform and teeth to alternate in up and down movement;

powering means for the drive cylinder;

control means for the powering means of the drive cylinder;

a circular saw, the saw disposed in the horizontal plane between the lower blade and the upper blade;

powering means for the saw;

control means for the saw power.

2. The invention in claim 1 wherein the stalk is further comprised of an upper stalk and a lower stalk;

adjustment means for adjusting the position of the upper stalk with the lower stalk, whereby the overall length of the upper and lower combined stalks is adjustable.

3. The invention in claim 2 wherein the control means for controlling power to the drive cylinder is a trigger control within the handle of the upper stalk.

4. The invention in claim 3 wherein a trigger guard partially surrounds the trigger control.

5. The invention in claim 4 wherein the handle further comprises a safety switch, the safety switch requiring depression prior to the trigger control being engaged.

6. The invention in claim 5 wherein the control means for the powering means for the saw is a saw control lever.

7. The invention in claim 6 wherein the saw control lever is disposed on the upper stalk.

8. The invention in claim 7 wherein the drive cylinder is pneumatically powered.

9. The invention in claim 7 wherein the drive cylinder is electrically powered.

* * * * *